US005858469A

United States Patent [19]

Sahoo et al.

[11] Patent Number: 5,858,469

[45] Date of Patent: Jan. 12, 1999

[54] METHOD AND APPARATUS FOR APPLYING COATINGS USING A NOZZLE ASSEMBLY HAVING PASSAGEWAYS OF DIFFERING DIAMETER

[75] Inventors: Purusottam Sahoo, Collegeville; Stephen G. Sitko, Telford, both of Pa.

[73] Assignee: Sermatech International, Inc., Limerick, Pa.

[21] Appl. No.: 564,915

[22] Filed: Nov. 30, 1995

[51] Int. Cl.[6] ..... C23C 4/10; B05C 5/04; B05B 1/24

[52] U.S. Cl. ..... 427/451; 427/446; 427/450; 239/79

[58] Field of Search ..... 427/446, 450, 427/451; 239/79

[56] References Cited

U.S. PATENT DOCUMENTS

| | | |
|---|---|---|
| 2,770,708 | 11/1956 | Briggs . |
| 2,960,594 | 11/1960 | Thorpe . |
| 3,010,009 | 11/1961 | Ducati . |

(List continued on next page.)

FOREIGN PATENT DOCUMENTS

| | | |
|---|---|---|
| 837030 | 3/1970 | Canada . |
| 1065203 | 10/1979 | Canada . |
| 2117731 | 7/1972 | France . |
| 473940 | 1/1937 | United Kingdom . |
| 876455 | 8/1961 | United Kingdom . |
| 915170 | 1/1963 | United Kingdom . |
| 943793 | 12/1963 | United Kingdom . |
| 958375 | 5/1964 | United Kingdom . |
| 967445 | 8/1964 | United Kingdom . |
| 972183 | 10/1964 | United Kingdom . |
| 990533 | 4/1965 | United Kingdom . |
| 1003118 | 9/1965 | United Kingdom . |
| 1012689 | 12/1965 | United Kingdom . |
| 1022556 | 3/1966 | United Kingdom . |
| 1125806 | 9/1968 | United Kingdom . |
| 1179301 | 1/1970 | United Kingdom . |
| 1209672 | 10/1970 | United Kingdom . |
| 1382089 | 1/1975 | United Kingdom . |
| WO90/12123 | 10/1990 | WIPO . |

OTHER PUBLICATIONS

"Comparison of Major Thermal–Spray Coating Processes" Data Sheet, *Advanced Materials & Processes,* pp. 58 and 59, Feb. 1992.

B.J. Gill, "Argon Shrouded Plasma Coatings for Gas Turbine Applications", *International Conference on PM Aerospace Materials* (Proceedings A89–33451 13–26), Lucerne, Switzerland, Nov. 2–4, 1987.

(List continued on next page.)

*Primary Examiner*—Katherine A. Bareford
*Attorney, Agent, or Firm*—Weiser & Associates, P.C.

[57] ABSTRACT

Known thermal spray apparatus are modified to achieve thermal spray coatings of increased hardness. Thermal spray apparatus operate to develop a plasma stream for introduction to a nozzle, for eventual application to the surface of a substrate. Upon entering the nozzle, the plasma stream is passed through a plasma cooling zone defined by a plasma cooling passageway, to a plasma accelerating zone defined by a narrowed passageway that expands into a plasma/particle confining zone for the discharge of material from the apparatus. The narrowed passageway of the apparatus is cooled, and the powder material to be applied by the apparatus is introduced into the plasma stream along the cooled, narrowed passageway. To apply thermal spray coatings of increased hardness to a substrate, the ratio of the length of the plasma/particle confining zone relative to the diameter of the plasma/particle confining zone (the "L/D" ratio) is increased from the more conventional value of about 5:1, preferably to a ratio in a range of from 7:1 to 16.5:1, for use with coating materials including WC—Co, $Cr_3C_2$—NiCr and $Cr_3C_2$. Ratios of from 10:1 to 13:1 have been found to achieve a particularly desirable result. Also the method and the coatings obtained.

42 Claims, 8 Drawing Sheets

U.S. PATENT DOCUMENTS

| | | | |
|---|---|---|---|
| 3,075,065 | 1/1963 | Ducati et al. . | |
| 3,140,421 | 7/1964 | Spongberg . | |
| 3,145,287 | 8/1964 | Siebein . | |
| 3,179,783 | 4/1965 | Johnson . | |
| 3,179,784 | 4/1965 | Johnson . | |
| 3,301,995 | 1/1967 | Eschenbach et al. . | |
| 3,304,402 | 2/1967 | Thorpe . | |
| 3,470,347 | 9/1969 | Jackson . | |
| 3,533,756 | 10/1970 | Houseman . | |
| 3,573,090 | 3/1971 | Peterson | 117/93.1 |
| 3,591,759 | 7/1971 | Stand | 219/76 |
| 3,668,108 | 6/1972 | Houseman | 204/323 |
| 3,676,638 | 7/1972 | Stand | 219/121 P |
| 3,684,911 | 8/1972 | Perugini | 313/231 |
| 3,740,522 | 6/1973 | Muehlberger | 219/121 P |
| 3,764,272 | 10/1973 | Sterling | 23/273 SP |
| 3,803,380 | 4/1974 | Ragaller | 219/121 P |
| 3,806,698 | 4/1974 | Hare et al. | 219/383 |
| 3,814,620 | 6/1974 | Bailey et al. | 117/93.1 PF |
| 3,823,302 | 7/1974 | Muehlberger | 219/121 P |
| 3,839,618 | 10/1974 | Muehlberger | 219/121 P |
| 3,851,140 | 11/1974 | Coucher | 219/121 P |
| 3,892,882 | 7/1975 | Guest et al. | 427/34 |
| 3,896,244 | 7/1975 | Ellis et al. | 427/34 |
| 3,914,573 | 10/1975 | Muehlberger | 219/76 |
| 4,004,735 | 1/1977 | Zverev et al. | 239/79 |
| 4,121,082 | 10/1978 | Harrington et al. | 219/76.16 |
| 4,127,760 | 11/1978 | Meyer et al. | 219/121 P |
| 4,146,654 | 3/1979 | Guyonnet | 427/34 |
| 4,235,943 | 11/1980 | McComas et al. | 427/34 |
| 4,236,059 | 11/1980 | McComas et al. | 219/121 P |
| 4,256,779 | 3/1981 | Sokol et al. | 427/446 |
| 4,416,421 | 11/1983 | Browning | 239/79 |
| 4,540,121 | 9/1985 | Browning | 239/13 |
| 4,568,019 | 2/1986 | Browning | 239/13 |
| 4,634,611 | 1/1987 | Browning | 427/423 |
| 4,741,286 | 5/1988 | Itoh et al. | 118/620 |
| 4,836,447 | 6/1989 | Browning | 239/8 |
| 4,869,936 | 9/1989 | Moskowitz et al. | 239/79 |
| 5,014,915 | 5/1991 | Simm et al. | 239/79 |
| 5,047,265 | 9/1991 | Simm et al. | 427/446 |
| 5,082,179 | 1/1992 | Simm et al. | 427/446 |
| 5,120,582 | 6/1992 | Browning | 427/423 |
| 5,330,798 | 7/1994 | Browning | 427/446 |
| 5,518,178 | 5/1996 | Sahoo et al. | 239/13 |

OTHER PUBLICATIONS

B.J. Gill and F.L.Ridding, "Argon Shrouded Plasma Spray Technology for Production Applications", *Surface Engineering,* vol. 2, No. 3, 1986. (No Month Date).

H.Herman, "Plasma–sprayed Coatings", *Scientific American,* Sep., 1988.

R.V. Hillery, B.H. Pilsner, R.L. McKnight, T.S. Cook and M.S. Hartle, "Thermal Barrier Coating Life Prediction Model Development –Final Report", *NASA Contractor Report 180807,* Nov., 1988.

"Hobart Tafa Acquires Advanced HVOF Technology", *Hobart Tafa Technologies,* Concord, New Hampshire, May, 1991.

"HVOF Turbine Engine Premium Coatings Guide—Metco 2600 Hybrid Performance", Metco–Perkin Elmer. (No Date).

G. Irons, "Higher Particle Velocities Produce Better Thermal Spray Coatings", *Hobart Tafa Technologies,* Concord, New Hampshire. (No Date).

G. Irons and V. Zanchuk, "Comparison of MCrAly Coatings Sprayed by HVOF and Low Pressure Processes", *Proceedings of the 1993 National Thermal Spray Conference,* Anaheim, California, Jun. 7–11, 1993.

E. Kubel, Jr. "Thermal Spraying Technology: From Art to Science", *Advanced Materials & Processes Inc. Metal Progress,* Dec., 1987.

D.W. Parker and G.L. Kutner, "HVOF–Spray Technology", *Advanced Materials & Processes,* pp. 68–74, Apr., 1991.

T.N. Rhys–Jones, "Applications of Thermally Sprayed Coating Systems in Aero Engines", *U.S. Department of Commerce, National Technical Information Service,* 1989. (No Month Date).

P. Sahoo and T.F. Lewis, "MCrAly + X Coatings Applied Using the High Velocity Gator–Gard Plasma Spray System", *Thermal Spray: International Advances in Coatings Technology, Proceedings of the International Thermal Spray Conference,* Orlando, Florida, May 28 –Jun. 5, 1992.

P. Sahoo and R. Raghuraman, "Gator–Gard® Applied Bond Coats for Thermal Barrier Coatings", *Proceedings of the 1993 National Thermal Spray Conference,* Anaheim, California, Jun. 7–11, 1993.

T.A. Taylor, M.P. Overs, B.J. Gill and R.C. Tucker, Jr., "Experience with MCrAl and Thermal Barrier Coatings Produced via Inert Gas Shrouded Plasma Deposition", *J. Vac. Sci. Technology,* A. vol. 3, No. 6, Nov./Dec. 1985.

M.L. Thorpe and H.J. Richter, "A Pragmatic Analysis and Comparison of HVOF Processes", *Hobart Tafa Technologies,* Concord, New Hampshire, pp. 1–27, 1992. (No Month Date).

United Technologies, Pratt & Whitney, "P & W Specification PWA–256" (Apr. 8, 1976).

S.C. Poulsen, "Le Chalumeau 'Plasmadyne' à arc plasma", *La Machine Moderne,* vol. 56, Apr., 1962.

N.N. Dorozhkin, et al., "Plasma Spraying of Self–Fluxing Alloys on to Heated Substrates" (Translated from *Poroshskovaya Metallurgiya,* No. 12 (144) pp. 51–56, Dec. 1974) pp. 993–996, 1975 (No Month Date).

50μm

METHOD AND APPARATUS FOR APPLYING COATINGS USING A NOZZLE ASSEMBLY HAVING PASSAGEWAYS OF DIFFERING DIAMETER

BACKGROUND OF THE INVENTION

The present invention relates generally to the thermal spraying of powdered materials, as well as their application to surfaces as protective coatings.

A variety of thermal spray coatings have long been used to protect various components. A principal variety of thermal spray coatings to which the subject matter of the present invention pertains includes plasma sprayed coatings, although the improvements of the present invention will also pertain to other coatings and processes such as high velocity oxy-fuel (HVOF), having similar uses and properties. Plasma spray processes have been used to apply many different types of coatings to a variety of substrates, and find utility in numerous industries. One such application is responsive to conditions where a high degree of stress and wear is prevalent. In such a case, protective coatings containing carbides are often used. For example, the mid-span stiffeners used in the fan blades of aircraft gas turbine engines are commonly coated with a highly wear resistant tungsten carbide-cobalt (WC—Co) coating.

Popular techniques for the application of such coatings would include plasma spraying and high velocity oxy-fuel spraying. In the implementation of such coatings, hardness is often a factor of primary concern. However, both plasma sprayed coatings and high velocity oxy-fuel coatings have proven to be limited in their ability to meet the minimum mechanical property requirements for certain applications, particularly the requirements for minimum hardness.

In the practice of such processes, the current trend in the industry has been to develop processes that increase particle velocity and deposition rates. For example, an article by M. L. Thorpe and H. J. Richter, entitled "A Pragmatic Analysis and Comparison of the HVOF Process", *Proceedings of the International Thermal Spray Conference & Exposition*, Orlando, Fla. (May 28 to Jun. 5, 1992), at pages 137–147, discusses the increase of particle velocities in thermal spray processes. However, these known techniques have remained somewhat limited in terms of the overall hardnesses which could be achieved.

U.S. Pat. No. 5,082,179 (Simm et al.), U.S. Pat. No. 4,741,286 (Itoh et al.) and U.S. Pat. No. 4,236,059 (McComas et al.) disclose flame sprayed coatings applied using a plasma spray process. Simm et al. disclose relatively low velocity, low temperature spray methods, which are generally not suited to severe wear and erosion applications. Itoh et al. similarly disclose coatings applied with a low rate plasma gas flow. Generally speaking, the disclosed systems provide no specific guidance relative to the development of plasma sprayed coatings of a hardness commensurate with many present applications.

U.S. Pat. No. 5,330,798 (Browning) discloses flame sprayed coatings applied with a high velocity oxy-fuel spray process. The disclosed process uses the kinetic energy of impacting particles to obtain dense coatings. However, again, the resulting coatings are not of a hardness commensurate with many present applications.

SUMMARY OF THE INVENTION

It is therefore the primary object of the present invention to provide thermal spray coatings for application to substrates which are improved in terms of their hardness characteristics.

It is also an object of the present invention to provide thermal spray coatings of improved hardness that employ traditional wear resistant materials.

It is also an object of the present invention to provide thermal spray coatings of improved hardness which can be implemented with existing thermal spray apparatus, and at a reasonable cost.

It is also an object of the present invention to provide an apparatus for applying thermal spray coatings of improved hardness to various substrates.

It is also an object of the present invention to provide a nozzle assembly for use with thermal spray apparatus for applying thermal spray coatings of improved hardness to various substrates.

It is also an object of the present invention to provide substrates with thermal spray coatings of improved hardness.

These and other objects which will be apparent are achieved in accordance with the present invention by modifying known thermal spray apparatus to achieve the thermal spray coatings of improved hardness which are desired.

For example, U.S. Pat. No. 4,256,779 (Sokol et al.) and U.S. Pat. No. 4,235,943 (McComas et al.) disclose a plasma spray method and apparatus which is known in the industry as the "Gator-Gard®" System, offered by Sermatech International, Inc. of Limerick, Pa. Generally speaking, the disclosed system includes a plasma-producing torch coupled with a nozzle for directing the resulting plasma stream to develop a plasma jet of improved characteristics. The disclosed system is useful in applying thermally sprayed coatings to desired substrates.

Upon entering the nozzle of the apparatus, the plasma stream is passed through a plasma cooling zone defined by a plasma cooling passageway, to a plasma accelerating zone defined by a narrowed passageway that expands into a plasma/particle confining zone for the discharge of material from the nozzle, and the thermal spray apparatus. The narrowed passageway of the apparatus is cooled, and the powder material to be applied to the substrate by the apparatus is introduced into the plasma stream along the cooled, narrowed passageway. This results in appropriate heating (melting) and acceleration of the powder particles, for application to the substrate which is to receive the thermal spray coating.

Such apparatus has worked well for applying coatings of various types to appropriate substrates. A variety of wear resistant coatings such as WC—Co and $Cr_3C_2$—NiCr have been effectively applied with such an apparatus. However, for purposes of improving the plasma spray coatings applied with such apparatus, and in accordance with the present invention, it has been found that plasma spray coatings of increased hardness can be applied to desired substrates by extending the distance at which the apparatus can spray the plasma/particle stream, preferably by a factor of two to three times the distance normally used.

It has been found that this is achievable by lengthening the passageway which defines the plasma/particle confining zone of the nozzle of the thermal spray apparatus. This, in turn, has an effect upon the ratio of this length to the diameter of the plasma/particle confining zone of the nozzle (generally referred to as the "L/D" ratio). For example, it has been found that an increase in this L/D ratio from a conventional value of about 5:1 to an increased value of about 12.5:1 will achieve significantly improved results for certain WC coatings which are conventionally used in the industry, as will be discussed more fully below. Variations in this ratio of from 7:1 to 16.5:1 will find utility in conjunction with other materials, for implementing similar coatings. Ratios of from 10:1 to 13:1 have been found to be particularly useful.

For further detail regarding such improvements, reference is made to the detailed description which is provided below, taken in conjunction with the following illustrations.

DETAILED DESCRIPTION OF PREFERRED EMBODIMENTS

Figure 1:
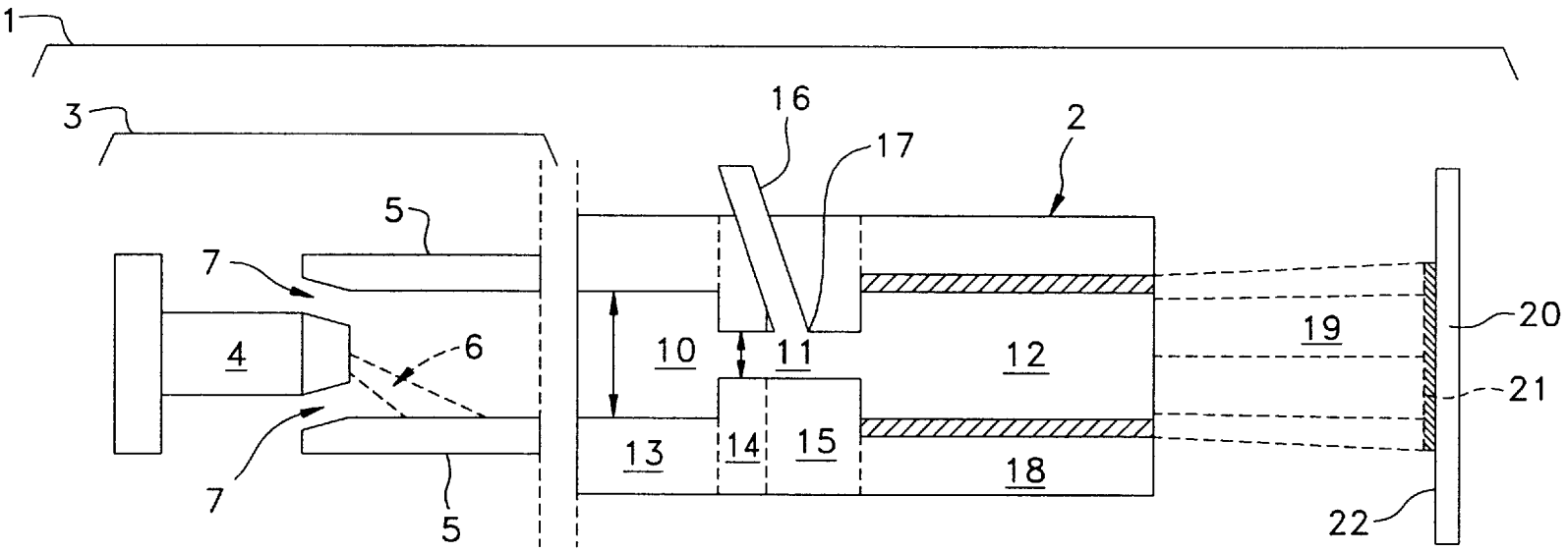
FIG. 1 is a schematic illustration of a plasma spray apparatus for implementing the improvements of the present invention.

FIG. 1 is a schematic representation of a thermal spray apparatus 1 corresponding to the thermal spray apparatus disclosed in U.S. Pat. No. 4,256,779 and incorporating the improvements of the present invention. The thermal spray apparatus 1 is generally comprised of a nozzle assembly 2 (i.e., an insert) which is mated to a plasma gun 3. The plasma gun 3 employs a cooperating cathode 4 (preferably formed of tungsten) and anode 5 (preferably formed of copper). The cathode 4 and anode 5 are electrically excited to produce an arc at 6, for igniting a plasma-forming gas (e.g., an inert gas such as helium) which is introduced at 7, between the cathode 4 and the anode 5.

The plasma gun 3 is mated with the nozzle assembly 2 so that the resulting plasma stream is introduced into an inlet passageway 10 of the nozzle assembly 2. The inlet passageway 10 communicates with a narrowed passageway 11, which thereafter expands outwardly into a ceramic nozzle 12. In operation, the plasma stream produced by the plasma gun 3 enters the inlet passageway 10. The inlet passageway 10 is surrounded by a cooling medium, such as water, to define a plasma cooling zone 13. In passing from the inlet passageway 10 to the narrowed passageway 11, the plasma stream is constricted along a zone 14. Thereafter, the plasma stream passes through a particle introduction zone 15 which incorporates one or more conduits 16 for receiving a powder to be introduced into the plasma stream through one or more ports 17. Upon entering the particle introduction zone 15, powder Introduced through the port 17 enters the narrowed passageway 11, where it is heated to a plasticized state and accelerated in the ceramic nozzle 12. The plasticized and accelerated powder particles are then discharged from this plasma/particle confining zone 18, exiting the nozzle assembly 2 as a spray 19 for application to an appropriate substrate 20. The result is a thermal spray coating 21 applied to the surface 22 of the substrate 20.

It has been found that the characteristics of the thermal spray coating 21 can be affected by varying the dimension of the passageway 12. As an example, the passageway 12 of a convention nozzle assembly 2 typically has a length of about 1.25 inches. In accordance with the present invention, it has been found that the applied coating 21 can be improved, particularly in terms of its hardness, by extending this length.

A more common parameter which is conventionally used in the industry is the "L/D" ratio, which is a ratio of the length of the passageway 12 relative to the inner diameter of the passageway 12. In accordance with the present invention, this ratio is preferably increased from a conventional value of about 5:1 to values in a range of from 7:1 to 16.5:1. Particularly useful results are obtained with ratios of from 10:1 to 13:1. The L/D ratio which is employed will vary depending upon the particular application involved (i.e., the substrate to receive the coating, the coating materials used, etc.). Although L/D ratios of between 5:1 and 7:1 can be effectively employed in developing hardened plasma spray coatings, it has been found that better results are achieved for coatings produced with L/D ratios of from 7:1 to 16.5:1, and particularly for ratios of from 10:1 to 13:1.

As an example, the passageway 12 of a conventional nozzle assembly 2 has a typical inner diameter of 0.25 inches (a typical outer diameter for the nozzle 12 would be 0.370 inches) and a typical length of 1.25 inches, yielding an L/D ratio of 5:1. Increasing the length of the passageway 12 to 3.125 inches (e.g., for a WC coating) will increase the L/D ratio to 12.5:1. L/D ratios in the preferred range of 7:1 to 16.5:1 will correspond to lengths ranging from 1.75 inches to 4.125 inches. L/D ratios in the optimum range of 10:1 to 13:1 will correspond to lengths ranging from 2.50 inches to 3.25 inches.

As previously indicated, the improvements of the present invention are useful with coatings formed of a variety of different materials, for application to various substrates, as desired. However, for purposes of illustration, the improvements of the present invention will be further discussed with reference to a particular class of coatings, specified as "GG-WC-102" coatings by Sermatech International, Inc. Such coatings are similarly specified as "PWA 256-4" Coatings by Pratt & Whitney Aircraft (United Technologies Corp.). The specified system uses a tungsten carbide-cobalt coating, which is widely applied in the aircraft industry and which has been found to be particularly responsive to improvement in accordance with the present invention.

One indication of the integrity of such a coating (applied, for example, using Sermatech's "Gator-Gard®" System) is the microhardness of the resulting coating. Typically, the value for microhardness which is required to yield an acceptable coating is on the order of 950 units ($DPH_{300}$). This value is a function of many process parameters, some of the more important variables being the gas flow rate, the current applied to the electrodes and the spray distance relative to the substrate.

Since the extended passageway 12 of the present invention forms part of the nozzle assembly 2, which can be separated from the plasma gun 3, this independently affixed component can be varied in configuration (in particular, its length) in straightforward fashion. These nozzle assemblies, which are commonly referred to in the industry as "blocks", are conventionally formed of copper (so-called "Cu-blocks").

Various nozzle assemblies having passageways 12 of a different length have been studied. For purposes of illustrating the improvements of the present invention, nozzle assemblies 2 having passageways 12 of five different lengths were compared. This included a "blockless" nozzle (length=0 inches), a standard nozzle (length=1.25 inches), and three lengthened nozzles including a "long" nozzle (length=1.75 inches), a "P" nozzle (length=3.125 inches) and a "P+" nozzle (length=4.125 inches). As a point of reference, and under typical conditions, a standard copper block was employed with a gas flow rate of 275 (arbitrary units) and a current of 800 to 840 amperes, for the application of coatings at a conventional spray distance of 2 inches.

Figure 2:
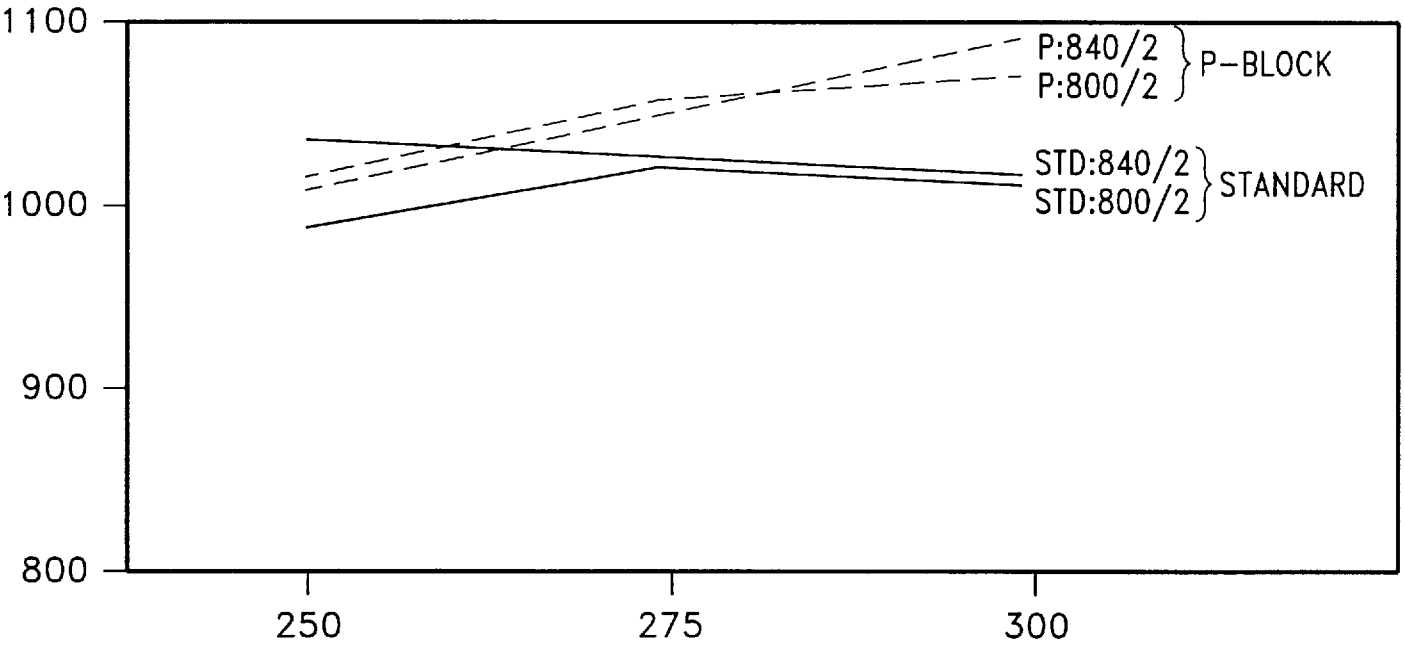
FIG. 2 is a graph showing variations in microhardness responsive to variations in gas flow rate for two different nozzles including a conventional nozzle and a nozzle incorporating the improvements of the present invention.

FIG. 2 is a graph showing variations in mircohardness responsive to variations in gas flow rate for two different blocks including a standard block and a P-block operating at two different current levels (800 and 840 amperes, respectively), at a spray distance of 2 inches. From this graph it is seen that the P-block yields coatings of increased hardness relative to coatings applied with the standard block, particularly at the higher gas flow rates.

Figure 3:
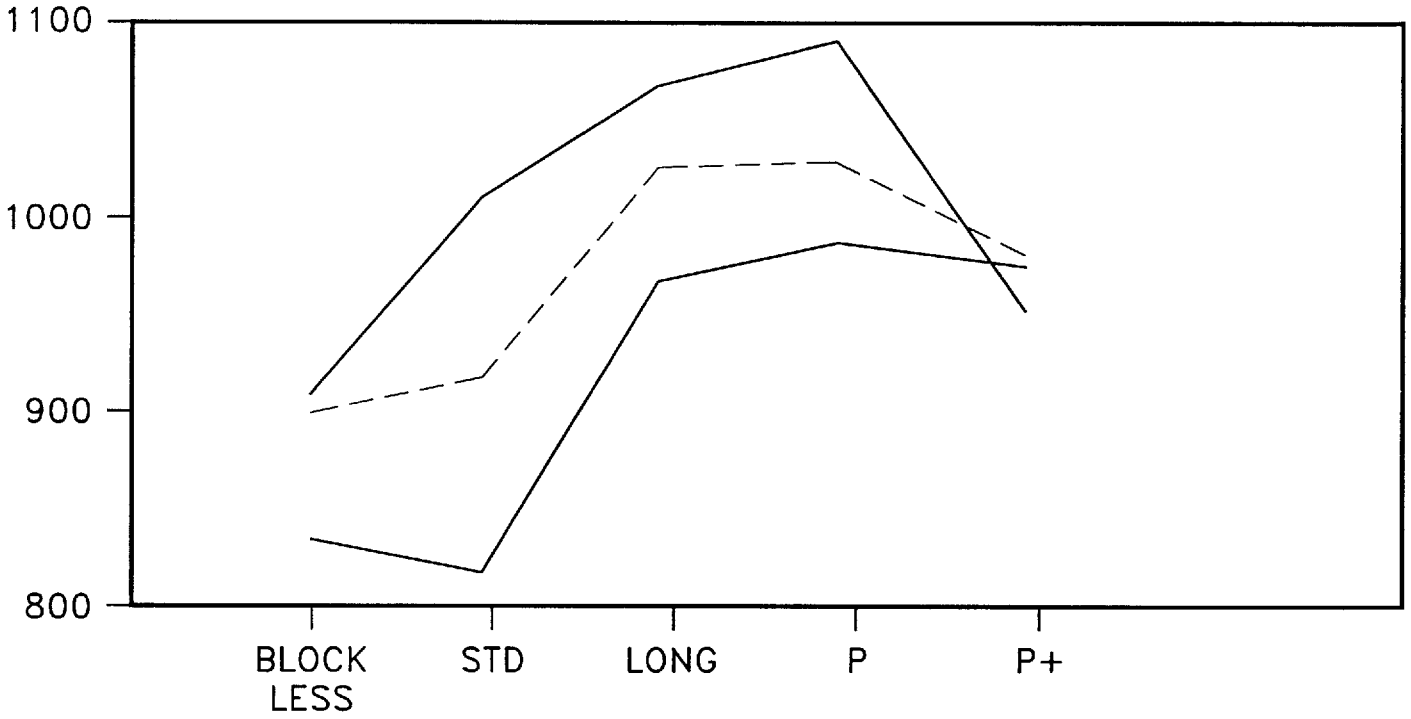
FIG. 3 is a graph showing variations in microhardness at different spray distances for different nozzles including a conventional nozzle and nozzles incorporating the improvements of the present invention.

FIG. 3 is a graph showing variations in microhardness as a function of block type, at various spray distances including 2, 3 and 4 inches, respectively. The spray apparatus was operated at 840 amperes, with a gas flow rate of 300 units. From this graph it is seen that in all cases, the hardness of the resulting coating tends to maximize for the P-block, rolling off for both longer and shorter passageways.

Figure 4:
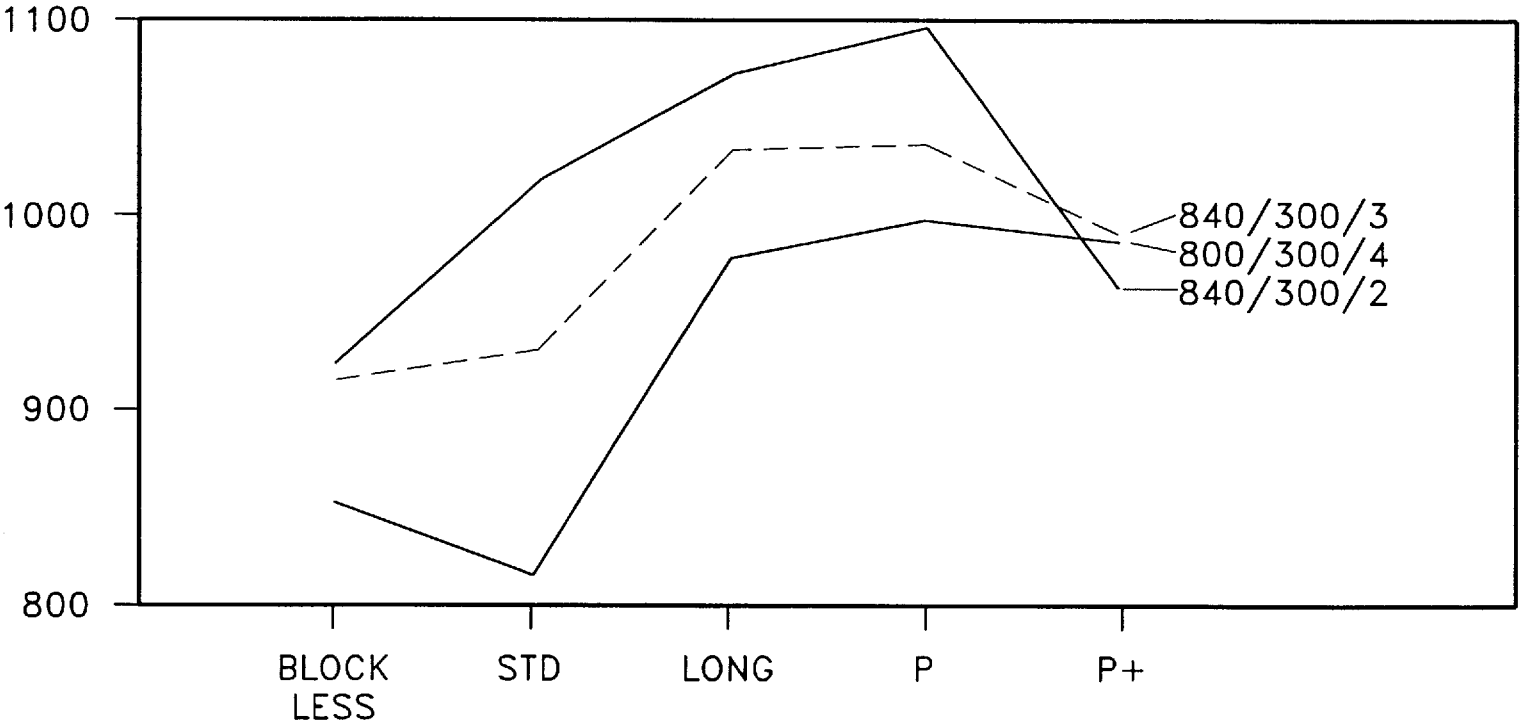
FIG. 4 is a graph similar to that of FIG. 3, showing results for different operating parameters.

FIG. 4 is a graph similar to the graph of FIG. 3, except that the spray apparatus was in this case operated at 800 amperes, with a gas flow rate of 300 units. Again, it is seen that in all cases, the hardness of the resulting coating tends to maximize for the P-block, rolling off for both longer and shorter passageways.

Figure 5:
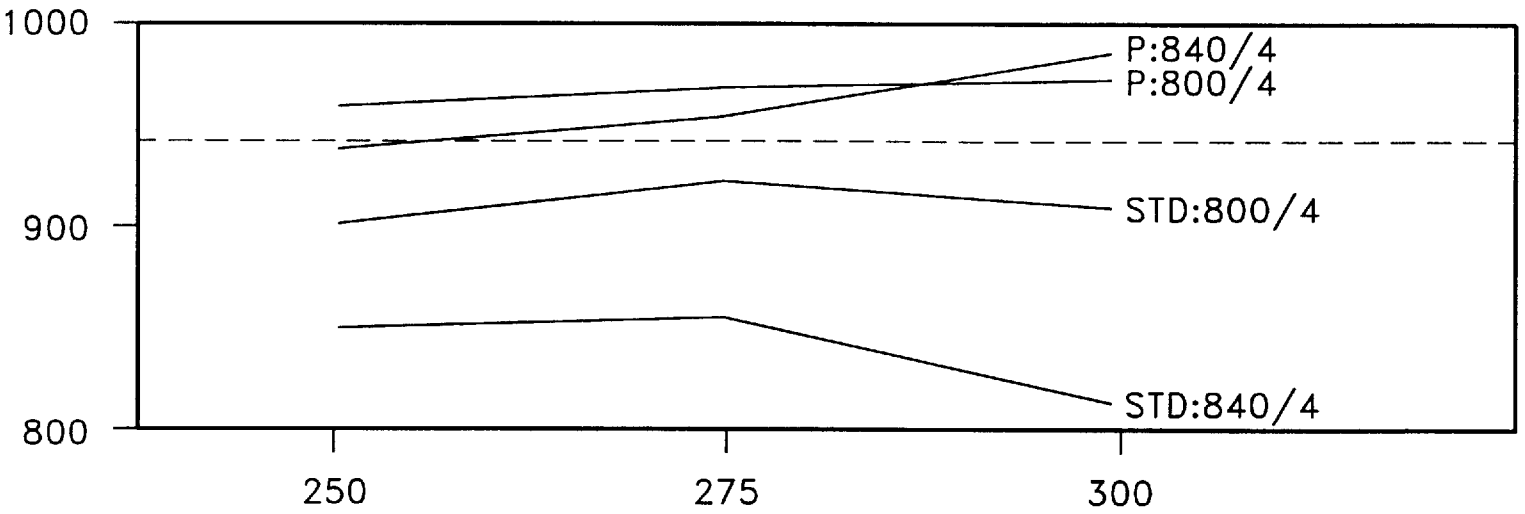
FIG. 5 is a graph similar to that of FIG. 2, showing results at an increased spray distance.

FIG. 5 is a graph similar to the graph of FIG. 2, except that the spray distance was in this case increased to 4 inches. The spray apparatus was operated at both 800 and 840 amperes, respectively. From this graph it is seen that at a spray distance of 4 inches, only the P-block meets an acceptable minimum microhardness level of 950 units. This illustrates that the P-block can be used to substantially double the spray distance which can be used in coating a desired substrate, relative to the spray distance used for a standard block (from 2 to 4 inches). Spray distances of from 3 to 6 inches (multiples of from 1.5 to 3 times the conventional spray distance of 2 inches) can be used in appropriate applications, responsive to suitable adjustment of the operating parameters for such applications.

From a practical standpoint, this leads to various improvements. First, increasing the spray distance permits parts that are not easily accessible to be effectively sprayed. This would include parts such as vanes and impellers, which are limited in terms of their accessibility due to the cables and hoses which are attached to the thermal spray apparatus (the gun 3) and which tend to obstruct the thermal spray procedure which is to take place. Second, increasing the spray distance causes less of the heat produced by the ignited gas to be transferred to the part which is being coating, which might otherwise have a deleterious effect on the part and/or the coating applied to the part. For example, parts formed of materials which can adversely respond to heat (such as steels, titaniums and the like) must be kept to a relatively low temperature (e.g., under 300° F.) if they are to maintain their desired physical properties. Increasing the spray distance, in accordance with the present invention, is useful in meeting such requirements.

In addition to the foregoing improvements, relative to the flexibility of the resulting thermal spray process, coatings produced with a P-block have been found to exhibit other improvements, relative to the coating characteristics which result.

To illustrate such improvements, coatings produced according to the above discussed specifications (Sermatech "GG-WC-102", Pratt & Whitney "PWA 256-4", or equivalent) were developed. Previously, it had been found that such coatings could not be consistently applied at working distances in excess of 2 inches. In accordance with the present invention, such coatings were applied using a P-block nozzle, at spray distances of up to 4 inches from the substrate. Mechanical properties and microstructures of the resulting coatings were then compared (standard block vs. P-block). More specifically, standard nozzles operating at a spray distance of 2 inches were compared with P-block nozzles operated at a spray distance of 3.5 inches, using process parameters appropriate to each design. Various specimens were sprayed for comparative purposes including Almen strips, SNECMA Drop Test specimens, and panels for microstructure, microhardness and X-ray diffraction studies. The Pratt & Whitney specification "PWA 256-4" was used as the standard for such testing. The following results were obtained.

Figure 6A:
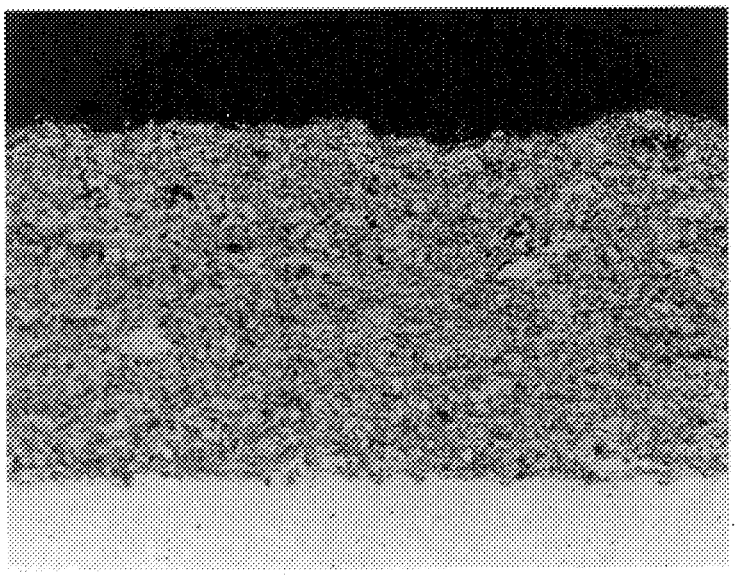
FIGS. 6A and 6B are photomicrographs comparing conventional coatings (FIG. 6A) with coatings produced in accordance with the present invention (FIG. 6B).
Figure 6B:
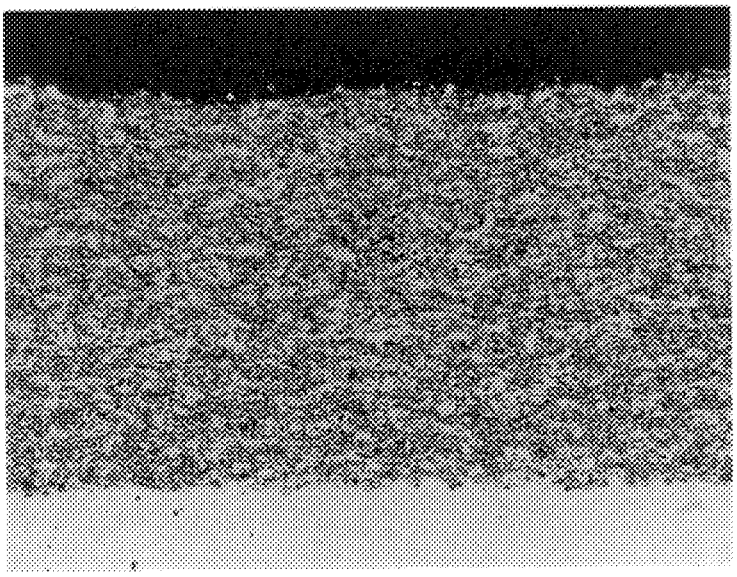

Photomicrographs of typical structures were obtained at a magnification of 200 (200×) for coatings achieved with both a standard block nozzle (FIG. 6A) and a P-block nozzle (FIG. 6B). No significant differences are observable from these photomicrographs, except that the coatings produced with the P-block nozzle appear slightly more dense. However, both coatings are within specified limits. Such coatings were further examined for cracks, oxides, carbide content and cobalt islands. In each case, the coatings produced with the P-block nozzle were found to be acceptable.

Almen strips were coated using both the standard block nozzle and the P-block nozzle, and the height of curvature was measured for such coatings. After subtracting the effects of grit blasting on curvature, intensities achieved for the standard block and P-block coatings were measured at −11N and −22N, respectively. These numbers provide an indication of the relative compressive stress imposed by the coating on the substrate. It is known that compressive stresses are helpful in offsetting fatigue debit due to the application of hardface coatings. The P-block coating would be expected, if anything, to enhance performance under fretting wear conditions.

Five specimens coated using a P-block nozzle were drop tested using a SNECMA Drop Test apparatus. All five specimens passed this test at a drop height of 1000 mm. Coatings applied with the standard block nozzle could also pass this test. Consequently, the impact resistance of coatings applied with the P-block nozzle can be expected to match those applied with a standard block nozzle.

Coatings applied with a P-block nozzle were subjected to numerous runs over various iterations, and measurements of microhardness were obtained. In all cases, the measured microhardness was over 1000 $DPH_{300}$. This would satisfy "PWA 256-4" specifications, which limit microhardness to 950 to 1200 units. Experimentation has yielded hardness values for coatings applied at a distance of 3.5 inches from the substrate of between 1003 and 1071 $DPH_{300}$. Although the exact nature of the correlation between hardness and wear resistance has not been established, it is widely accepted that a minimum of 1000 $DPH_{300}$ is required for acceptable wear resistance under the conditions to which a fan blade mid-span area will be exposed. In the course of such testing, the resulting substrate temperatures were found to be lower for coatings applied with a P-block nozzle, primarily because the thermal spray apparatus was further away from the part being coated.

X-ray diffraction is typically used to measure the relative content of various phases present in a coating. Many such phases may be present in a tungsten carbide-cobalt coating including, for example, WC, $W_2C$, $Co_3W_3C$, $Co_2W_4C$, and other combinations of such elements. Previous studies relative to such coatings have shown that the primary phases present are WC, $W_2C$ and $Co_3W_3C$. The phase constituted of $W_2C$ is generally not present in the powder, in the form received, but rather forms as a result of the decarburization that occurs as a result of the thermal spray process. Although the $W_2C$ phase is harder than the WC phase, the former phase is not particularly desirable because it is a more brittle phase than the WC phase.

Figure 7A:
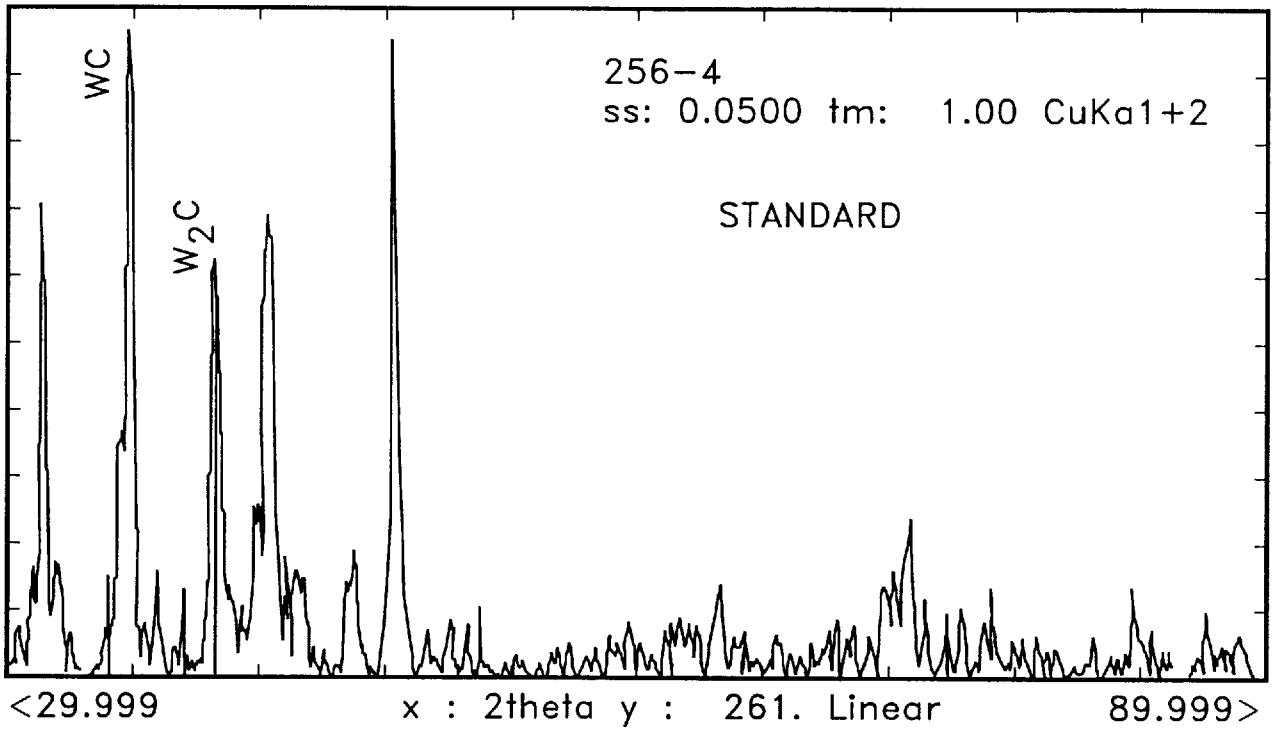
FIGS. 7A and 7B show X-ray diffractions comparing conventional coatings (FIG. 7A) with coatings produced in accordance with the present invention (FIG. 7B).

Coatings produced with both the standard block nozzle and a P-block nozzle were analyzed under a standard set of X-ray diffraction parameters. The resulting diffractograms are shown in FIG. 7A (for a standard block nozzle) and FIG. 7B (for a P-block nozzle). For the purposes of this study, a comparison was made relative to the ratio of the WC peak to that of the $W_2C$ peak. While a comparison of the area under each curve would generally be considered a more accurate method, this is rather difficult to implement, and a comparison of peak height ratios is considered to be an acceptable method for making such comparisons.

Figure 7B:
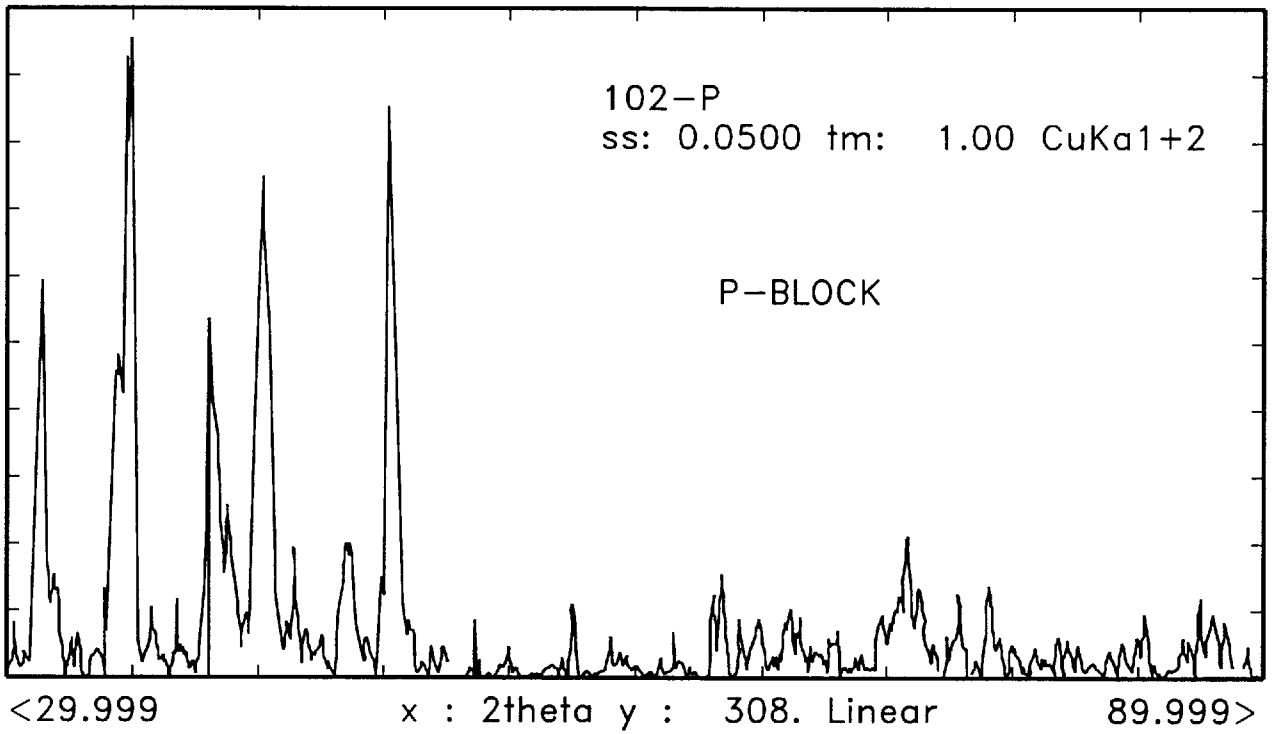

The diffractograms of FIGS. 7A and 7B show the WC and $W_2C$ peaks between 28 angles normally used for such coatings. For the purpose of comparison, only the primary WC and $W_2C$ peaks are labeled in the diffractograms of FIGS. 7A and 7B. The resulting measurements indicate ratios of 1.6 and 1.8 for coatings produced with the standard block nozzle and the P-block nozzle, respectively. This would suggest that coatings produced with the P-block nozzle cause less decarburization of the powder. In other words, coatings produced with the P-block nozzle had more of the desired phase, namely WC, than coatings produced with the standard block nozzle. This should also lead to enhancement of the coatings produced with the P-block nozzle in terms of their impact wear properties.

From the above, it is concluded that coatings produced with the P-block nozzle of the present invention will exhibit no detrimental properties relative to coatings produced with a standard block nozzle. However, the resulting coatings, when produced with a P-block nozzle, will benefit from the enhanced microstructural properties which are observed during the coating process including higher compressive stress on the substrate, lower $W_2C$ phase formation, and lower substrate temperature.

In addition to the above described WC—Co coatings, coatings produced with a P-block nozzle and comprised of $Cr_3C_2$—NiCr or comprised of $Cr_3C_2$ have been found to yield improved results. For example, chromium carbide coatings sprayed with a P-block nozzle, in accordance with the present invention, were found to be harder and more dense structures than similar coatings produced with a standard block nozzle. Again, this is important since the industry standard is to obtain harder coatings, which are considered to be more resistant to wear.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A method for thermal spray application of coatings to substrates, comprising the steps of:

introducing a heated jet stream into a nozzle assembly including a first passageway for receiving the heated jet stream therein, wherein the first passageway has an inner diameter, a second passageway in communication with the first passageway and adapted to receive the heated jet stream therein, wherein the second passageway has an inner diameter which is less than the inner diameter of the first passageway, and a third passageway in communication with the second passageway and adapted to receive the heated jet stream therein, wherein the third passageway is substantially cylindrical in shape and has an inner diameter which is greater than the inner diameter of the second passageway, and a defined length, wherein the length of the third passageway relative to the inner diameter of the third passageway forms a ratio greater than 5:1;

accelerating the heated jet stream as it passes from the first passageway to the second passageway;

introducing particles of material for producing the coatings into the second passageway; and spraying the heated jet stream containing the particles of material through the third passageway and toward the substrate, and depositing a hardened coating of the particles of material on the substrate.

2. The method of claim 1 wherein the heated jet stream is a plasma stream.

3. The method of claim 1 wherein the substrate has a surface, and wherein the coating is applied directly to the surface of the substrate.

4. The method of claim 1 wherein the ratio is no greater than 16.5:1.

5. The method of claim 4 wherein the ratio is from 7:1 to 16.5:1.

6. The method of claim 5 wherein the ratio is from 10:1 to 13:1.

7. The method of claim 6 wherein the ratio is about 12.5:1.

8. The method of claim 1 wherein the diameter of the third passageway is about 0.25 inches, and wherein the length of the third passageway is from 1.75 inches to 4.125 inches.

9. The method of claim 8 wherein the length is 3.125 inches.

10. The method of claim 1 wherein the substrate is located at a distance from the nozzle assembly, and wherein the distance is greater than two inches.

11. The method of claim 10 wherein the distance is from 3 inches to 6 inches.

12. The method of claim 11 wherein the distance is from 3.5 inches to 4.0 inches.

13. The method of claim 1 which further comprises the step of producing the heated jet stream with a plasma spray apparatus.

14. The method of claim 1 wherein the coatings have a hardness of at least 950 $DPH_{300}$.

15. The method of claim 1 wherein the coatings are formed of a material selected from the group consisting of WC—Co, $Cr_3C_2$—NiCr and $Cr_3C_2$.

16. The method of claim 1 which further includes the step of cooling the heated jet stream within the first passageway.

17. The method of claim 16 which further includes the step of accelerating the heated jet stream within the second passageway.

18. The method of claim 17 wherein the particles of material are introduced into the second passageway, following the accelerating step.

19. A thermal spray apparatus for applying coatings to substrates, comprising:

means for producing a heated jet stream, and a nozzle assembly mated with the heated jet stream producing means;

wherein the nozzle assembly includes a first passageway in communication with the heated jet stream of the producing means and adapted to receive the heated jet stream therein, the first passageway having an inner diameter, a second passageway in communication with the first passageway and adapted to receive the heated jet stream therein, the second passageway having an inner diameter which is less than the inner diameter of the first passageway, and a third passageway in communication with the second passageway and adapted to receive the heated jet stream therein, the third passageway being substantially cylindrical in shape and having an inner diameter which is greater than the inner diameter of the second passageway, and a defined length; and wherein the length of the third passageway relative to the inner diameter of the third passageway forms a ratio greater than 5:1.

20. The apparatus of claim 19 wherein the ratio is no greater than 16.5:1.

21. The apparatus of claim 20 wherein the ratio is from 7:1 to 16.5:1.

22. The apparatus of claim 21 wherein the ratio is from 10:1 to 13:1.

23. The apparatus of claim 22 wherein the ratio is about 12.5:1.

24. The apparatus of claim 19 wherein the inner diameter of the third passageway is about 0.25 inches, and the length of the third passageway is from 2.50 inches to 4.125 inches.

25. The apparatus of claim 24 wherein the length is 3.125 inches.

26. The apparatus of claim 19 wherein the thermal spray apparatus is a plasma spray apparatus.

27. The apparatus of claim 19 wherein the apparatus is adapted to form coatings having a hardness of at least 950 $DPH_{300}$.

28. The apparatus of claim 19 wherein the apparatus is adapted to form coatings of a material selected from the group consisting of WC—Co, $Cr_3C_2$—NiCr and $Cr_3C_2$.

29. The apparatus of claim 19 which further includes means for introducing particles of a material for forming the coatings into the second passageway.

30. The apparatus of claim 29 wherein the particle introducing means is a conduit for receiving the particles and having a port for communicating with the second passageway.

31. A nozzle assembly for a thermal spray apparatus capable of applying coatings to substrates, comprising a first passageway for receiving a heated jet stream therein, wherein the first passageway has an inner diameter, a second passageway in communication with the first passageway and adapted to receive the heated jet stream therein, wherein the second passageway has an inner diameter which is less than the inner diameter of the first passageway, and a third passageway in communication with the second passageway and adapted to receive the heated jet stream therein, wherein the third passageway is substantially cylindrical in shape and has an inner diameter which is greater than the inner diameter of the second passageway, and a defined length, wherein the length of the third passageway relative to the inner diameter of the third passageway forms a ratio greater than 5:1.

32. The nozzle assembly of claim 31 wherein the ratio is no greater than 16.5:1.

33. The nozzle assembly of claim 32 wherein the ratio is from 7:1 to 16.5:1.

34. The nozzle assembly of claim 33 wherein the ratio is from 10:1 to 13:1.

35. The nozzle assembly of claim 34 wherein the ratio is about 12.5:1.

36. The nozzle assembly of claim 31 wherein the diameter of the third passageway is about 0.25 inches, and the length of the third passageway is from 1.75 inches to 4.125 inches.

37. The nozzle assembly of claim 36 wherein the length is 3.125 inches.

38. The nozzle assembly of claim 31 wherein the thermal spray apparatus is a plasma spray apparatus.

39. The nozzle assembly of claim 31 wherein the apparatus is adapted to form coatings having a hardness of at least 950 $DPH_{300}$.

40. The nozzle assembly of claim 31 wherein the apparatus is adapted to form coatings of a material selected from the group consisting of WC—Co, $Cr_3C_2$—NiCr and $Cr_3C_2$.

41. The nozzle assembly of claim 31 which further includes means for introducing particles of a material for forming the coatings into the second passageway.

42. The nozzle assembly of claim 41 wherein the particle introducing means is a conduit for receiving the particles and having a port for communicating with the second passageway.

* * * * *